United States Patent [19]

Lewis et al.

[11] 4,062,681

[45] Dec. 13, 1977

[54] ELECTROPHOTOGRAPHIC ELEMENT HAVING A HYDROPHOBIC, CURED, HIGHLY CROSS-LINKED POLYMERIC OVERCOAT LAYER

[75] Inventors: William C. Lewis; Robert P. Darrow; William E. Yoerger, all of Rochester, N.Y.

[73] Assignee: Eastman Kodak Company, Rochester, N.Y.

[21] Appl. No.: 339,681

[22] Filed: Mar. 9, 1973

Related U.S. Application Data

[63] Continuation-in-part of Ser. No. 275,665, June 27, 1972, abandoned.

[51] Int. Cl.[2] ..... G03G 5/14

[52] U.S. Cl. ..... 96/1.5 N; 96/1.8

[58] Field of Search ..... 96/1.5, 1.8; 117/218

[56] References Cited

U.S. PATENT DOCUMENTS

| | | | |
|---|---|---|---|
| 2,860,048 | 11/1958 | Deubner | 96/1.5 |
| 3,140,174 | 7/1964 | Clark | 117/218 X |
| 3,407,064 | 10/1968 | Bach et al. | 96/1.8 |
| 3,438,706 | 4/1969 | Tanaka et al. | 355/11 |
| 3,438,773 | 4/1969 | Hayashi et al. | 96/1.5 |
| 3,482,970 | 12/1969 | Solodar et al. | 96/1.5 |
| 3,507,647 | 4/1970 | Sanders | 96/1.5 |
| 3,547,678 | 12/1970 | Conley | 96/1.5 X |
| 3,629,000 | 12/1971 | Back et al. | 117/218 |
| 3,669,657 | 6/1972 | Adams et al. | 96/1.8 |
| 3,753,709 | 8/1973 | Staudenmayer et al. | 96/1.5 |

*Primary Examiner*—David Klein
*Assistant Examiner*—John R. Miller
*Attorney, Agent, or Firm*—Arthur H. Rosenstein

[57] ABSTRACT

The present invention relates to a hydrophobic overcoat for an electrophotographic element. The overcoat contains a polymeric composition such as a homopolymer, copolymer, or blend thereof and an $\alpha,\beta$-ethylenically unsaturated carboxylic acid or the partial alkyl ester thereof and a relatively large amount of cross-linking agent for said polymeric composition, for example, an imine-terminated cross-linking agent or a melamine-formaldehyde resin.

11 Claims, No Drawings

ELECTROPHOTOGRAPHIC ELEMENT HAVING A HYDROPHOBIC, CURED, HIGHLY CROSS-LINKED POLYMERIC OVERCOAT LAYER

This application is a continuation-in-part of U.S. Ser. No. 275,665 filed July 27, 1972 now abandoned.

This invention relates to electrophotography and to electrophotographic elements having a novel hydrophobic overcoat layer.

In conventional electrophotographic office copy systems, it is generally desirable to utilize a reusable light-sensitive photoconductive element. In such devices, the reusable photoconductive element is utilized to form an electrostatic charge pattern corresponding to an original image. The resultant charge pattern is then developed using conventional electrostatically attractable toner particles and subsequently the toner particle image is transferred to the final copy sheet, e.g. ordinary bond paper. As is well known, a primary advantage of an electrophotographic copying system which employs a reusable photoconductive element is that the amount of photoconductive material is minimized. Typically thousands of images are made on a single reusable photoconductive element. To maximize efficiency in such office copying devices, it has been found advantageous to provide protective overcoats for such reusable photoconductive elements to provide even longer wear life for the element. Such protective overcoats may also be used even on photoconductive elements which are used only once or several times but which are subjected to physical or chemical treatment(s) during processing which may have a deleterious effect on the photoconductive layer of the element.

Although a primary purpose of a useful overcoat for a photoconductive layer of an electrophotographic element is to protect the underlying photoconductive layer, a useful overcoat must satisfy a number of additional, often conflicting, criteria. For example, the overcoat must not interfere with the electrical and sensitometric properties of the photoconductive layer of the element. In addition, useful overcoats should not promote, but advantageously should reduce or eliminate the formation of residual electrostatic images which frequently are induced on photoconductive elements subjected to multiple, superimposed image cycles.

One problem associated with many prior art coating compositions which have shown utility in certain specific electrophotographic applications, such as in the manufacture of electrophotographic lithoplates, is the hydrophilic character of such coatings. Hydrophilicity is desirable for an overcoat used on a lithoplate photoconductive element because it facilitates the use of the element as a printing plate in a conventional lithographic press. Overcoats of this type are described, for example, in U.S. Pat. No. 3,507,647 issued Apr. 21, 1970 and U.S. Pat. No. 3,407,064 issued Oct. 22, 1968 as well as in copending U.S. patent application Ser. Nos. 119,050 filed Feb. 25, 1971, now U.S. Pat. No. 3,753,709, issued Aug. 21, 1973 and Ser. No. 69,176 filed Sept. 2, 1970, (French Pat. No. 2,101,392 issued March 6, 1972), now abandoned in favor of continuation-in-part Ser. No. 309,829, filed Nov. 27, 1972. However, due to the hydrophilic properties of such overcoats, these overcoats are not suitable in conventional office copy devices where it is necessary to eliminate, as much as possible, the effect of environmental humidity conditions on the operation of the office copier. In short, an overcoat composition for use on a photoconductive element to be employed in a conventional office copy machine should be hydrophobic, not hydrophilic.

Useful overcoat compositions should exhibit good resistance to abrasion and scratching which can occur in typical office copy machines as a result of typical processing operations, for example, contacting the photoconductive element with conventional developer materials, rollers, cleaning devices, e.g. brushes, etc. Abrasion and scratching of the overcoat tends to lead to the formation of a scum layer, i.e. a build-up of developer materials, on the photoconductive element which is difficult to remove with standard cleaning techniques utilized in conventional office copy machines. Moreover, scumming of the photoconductive element will gradually lead to similar undesirable background markings on the resultant copies being produced by the machine.

In the past, it has been suggested that a suitable protective coating for a photoconductive element might be prepared by utilizing conventional techniques to cross-link a resin binder contained in a photoconductive insulating layer of a photoconductive element so as to completely or partially thermoset to resin binder. See U.S. Pat. No. 3,140,174 issued July 7, 1964, Col. 2, lines 35–46. Typically, conventional cross-linked thermoset resins are formed using relatively small amounts of a cross-linking agent based on the amount of the cross-linkable resin or polymer, In such conventional cross-linked thermoset resins, less than 10% by weight, generally less than about 5% by weight of the cross-linking agent (based on the amount of polymer to be cross-linked) is utilized. Using such conventional cross-linking techniques to cross-link the surface of the polymeric binder of a photoconductive insulating layer, it has generally not been possible heretofor to provide completely satisfactory hydrophobic protective layers for photoconductive elements. In fact, as demonstrated hereinafter, even when a conventional cross-linked resin composition is applied as a separate layer to the surface of a photoconductive element, the resultant element is not completely satisfactory for use in conventional office copy systems.

In accordance with the present invention, an improved electrophotographic element comprising a conductive support bearing a photoconductive insulating composition is provided by overcoating the photoconductive insulating composition with an improved hydrophobic overcoat layer. The overcoat utilized in the invention is a highly cross-linked polymeric material. In accord with the various embodiments of the invention, the polymeric material is comprised of a cross-linkable polymeric composition such as (*a*) a polymer of at least one $\alpha,\beta$-ethylenically unsaturated carboxylic acid or the partial alkyl ester thereof, (*b*) a copolymerized blend comprising at least about 25 percent by weight of a $\alpha,\beta$-ethylenically unsaturated carboxylic acid or the partial alkyl ester thereof and at least one other organic compound comprising 3 to about 20 carbon atoms and a polymerizable ethylenically unsaturated hydrocarbon moiety, or (*c*) a blend comprising at least about 25 percent by weight of a polymer of at least one $\alpha,\beta$-ethylenically unsaturated carboxylic acid or the partial alkyl ester thereof and a polymer of at least one other organic compound comprising 3 to about 20 carbon atoms and a polymerizable ethylenically unsaturated hydrocarbon moiety, together with a cross-linking agent for the polymeric composition. The resultant highly cross-linked polymeric material is comprised of at least 10% by weight of the cross-linking agent and preferably from about 20 to about 80% by weight of the cross-linking agent.

Although the amounts of cross-linking agents utilized herein maybe less than 50% by weight of the resin, these amounts are considered to be extremely large with respect to the prior art practice of using 5% or less of the cross-linking agent. Typically, the amount of cross-linking agent used in conventional systems is just enough to cross-link the resin.

The improved overcoated electrophotographic element of the present invention provides a number of advantages. For example, the above-described overcoats exhibit excellent wear characteristics when subjected to conventional electrophotographic processing. Moreover, due to the hydrophobicity of these overcoats, such overcoats exhibit good resistance to water, and therefor electrophotographic elements overcoated with such layers may be successfully employed even under relatively high humidity conditions. Furthermore, the overcoated electrophotographic elements described hereinabove exhibit a substantial reduction in scumming and improved resistance to abrasion such as may occur when the electrophotographic element is contacted with a developer composition or subjected to various cleaning operations, such as a rotating brush, etc. Also, such overcoat layers confer on the electrophotographic element generally improved properties as noted immediately hereinbefore while exerting no significant adverse effects on the electrical and sensitometric properties of the element to which it is applied. In addition, the problem of residual image formation which often occurs when one of various other types of overcoating compositions or when no overcoating composition at all is utilized on an electrophotographic element is greatly reduced or eliminated. Furthermore, because of the extreme hardness and abrasion resistance conferred on an electrophotographic element having the above-described overcoat, little or no accumulations or "microdeposits" of foreign particulate matter is capable of embedding in a photoconductive element having such an overcoat. Such microdeposits are often observed on a photoconductive element which is electrophotographically developed utilizing a magnetic brush developing technique. These microdeposits embedded in the surface are believed to be small particles deposited on the photoconductive element as it is contacted during development by a rotating magnetic brush such as that described in U.S. Pat. No. 3,003,462 issued Oct. 10, 1961. Such microdeposits cannot generally be removed by conventional electrographic cleaning techniques. Moreover, large accumulations of microdeposits can contribute to scumming of the photoconductive element.

The above-described improvements and advantages obtained through the use of the overcoated electrophotographic elements of the present invention are apparently due in large part to the large amounts of cross-linking agents employed in the overcoat composition. This in itself represents a surprising, unexpected aspect of the present invention. That is, normally a cross-linkable thermosetting resin system comprising a cross-linkable polymeric composition employs relatively small amounts of cross-linking agents to become substantially completely cross-linked and thermoset. Generally the weight ratio of the cross-linking agent to the cross-linkable polymer is less than about 1 part by weight cross-linking agent for every 10 parts by weight of cross-linkable polymer. In fact, to applicant's knowledge, it has generally been preferred in the prior art to use smaller amounts of the cross-linking agent, for example, from about 0.25 to about 5% by weight of the cross-linking agent based on the weight of the cross-linkable polymer. Accordingly, it is readily apparent that the overcoat composition used in the present invention where there is always at least 10% by weight of cross-linking agent and preferably from about 20 to about 80% by weight of the cross-linking agent represents a significant surprising deviation from conventional cross-linked thermoset resinous coating compositions. The exact theoretical reason for the enhanced abrasion resistance, humidity resistance and adhesion, together with the fact that the large amount of cross-linking agent does not interfere with electrical properties of the element, is not fully understood at present, and the present invention is not limited by the following hypothesis which has been advanced as a partial explanation for the phenomena of the invention. However, it has been hypothesized that the cross-linking agent may be forming a part of the molecular structure of the polymer backbone as well as providing cross-links between adjacent polymeric chains. This might account, at least in part, for the relatively large amounts of cross-linking agent which are used in the present invention.

The cross-linking agent employed in the highly cross-linked polymeric overcoat composition used in the present invention can be any of a number of well-known substances widely used for this purpose. Exemplary of suitable such materials are diepoxy reactive modifiers, such as 1,4-butanedioldiglycidyl ether, and aminoplast resins which are produced from the condensation products of amines or amides with an aldehyde. The most common aminoplast resins are urea-formaldehyde resins and melamine-formaldehyde resins. However condensation products of other amines and amides can also be employed, for example, those of triazines, diazines, triazoles, guanidines, guanamines and alkyl and aryl substituted derivatives of such compounds including alkyl and aryl substituted ureas and alkyl and aryl substituted melamines provided at least one amino group is present. Some examples of such compounds are N,N'-dimethyl urea, benzoguanimine, 6-methyl-2,4-diamino-1,3,5-triazine, 2,4,6-triphenyltriamino-1,3,5-triazine and the like. The aldehyde may be formaldehyde, although similar condensation products can be made from other aldehydes, such as acetaldehyde. In some cases, all or part of the alkylo groups of the condensation product are etherified by reaction with an alcohol to provide organic solvent-soluble materials. Any monohydric alcohol can be employed for this purpose, the preferred alcohols being methanol and butanol. Some preferred aminoplasts are melamine hardeners including melamine-formaldehyde resins such as those available from the Rohm and Haas Co. under the tradename of Uformite MM-47 and other melamine compounds such as hexamethoxy methylmelamine. Especially preferred melamine hardeners are the melamine formaldehyde resins.

Other cross-linking agents useful in this invention are phenolic resins formed by the condensation of an aldehyde and a phenol. Aldehydes used are similar to those described above. Various phenols can be used, for instance, the phenol employed can be phenol per se, a cresol or a substituted phenol in thich a hydrocarbon radical having either a straight chain, a branched chain or a cyclic structure is substituted for a hydrogen atom in the aromatic ring. Mixtures of phenols are also often employed. Some specific examples of phenols utilized to produce these resins include p-phenylphenol, p-tert-butylphenol, p-tert-amylphenol, cyclopentylphenol and unsaturated hydrocarbon substituted phenols, such as the monobutyl phenols containing a butenyl group in ortho, meta or para position, and where the double bond occurs in various positions in the hydrocarbon chain. The most common phenolic resin is phenolformaldehyde.

Still other cross-linking agents are dialdehydes such as glyoxal which are reactive with polymers containing active methylene groups. Formaldehyde and bis(vinylsulfonyl) ether compounds are also useful for hardening copolymers containing active methylene groups. Particularly useful bis(vinysulonyl) ether compounds are those disclosed in Burness et al., U.S. Pat. Nos. 3,490,911 issued Jan. 20, 1970, and 3,539,644 issued Nov. 10, 1970.

In accordance with another embodiment of the present invention, it has been discovered that an imine-terminated cross-linking agent such as the imine-terminated pre-polymers sold, for example, under the tradename of ITP-63, by Interchemicals Co., is particularly useful. These latter imine-terminated pre-polymer cross-linking agents are useful since they tend to react with the cross-linkable polymer at lower temperatures. Moreover, the overcoat composition containing these imine-terminated pre-polymer cross-linking agents have been found to exhibit good adhesion and greater water resistance. It should be emphasized, however, that the present invention is not restricted to a particular variety of cross-linking substances. As indicated above and in the working examples, good results may be obtained using a variety of different cross-linking agents.

The preferred cross-linking agents are melamine-formaldehyde resins and imine-terminated bifunctional or trifunctional prepolymers. Typically the imine-terminated materials have a molecular weight within the range of from about 1000 to about 10,000. The imine content of the trifunctional prepolymers typically varies from about 0.3 meq. of imine per gram of prepolymer for the higher molecular weight prepolymers to about 0.8 meq. of imine per gram of prepolymer for the lower molecular weight prepolymers. A particularly useful imine-terminated prepolymer is the reaction product of (1) toluene 2,4-diisocyanate, (2) a polyethertriol such as that commercially available from the Dow Chemical Co. under the tradename of Polyglycol 15-200, and (3) an imine. Such an imine-terminated prepolymer provides a resultant overcoat exhibiting good hydrophobicity and adhesion properties. Representative of such materials are imine-terminated prepolymers commercially available from Interchemicals Co. under the tradename of ITP-63. Since these materials are well known in the polymer art and commercially available, extended discussion thereof concerning the method of making such materials is deemed unnecessary. However, if additional details are desired, reference may be made to Bownes et al, U.S. Pat. No. 3,472,802 issued Oct. 14, 1969, particularly Example 12 thereof.

The $\alpha,\beta$-unsaturated carboxylic acid used in the overcoat composition of the present invention may be selected from a variety of known polymerizable carboxylic acids including, for example, methacrylic acid, itaconic acid, acrylic acid, maleic acid, crotonic acid, fumaric acid, citraconic acid and the like. Typically such carboxylic acids contain from at least 3 up to about 20 carbon atoms, preferably from 3 to about 8 carbon atoms. Both monocarboxylic and polycarboxylic acids may be utilized. The partial alkyl ester of such carboxylic acids which are useful in the present invention has reference to the half-acid, half-ester of an $\alpha,\beta$-ethylenically unsaturated dicarboxylic acid, such as acetoacetoxyethyl methacrylate and the like. Generally, as is well known in the polymer art, polymerizable ethylenically unsaturated carboxylic acids or their partial alkyl esters include those organic compounds having one or two carbon atoms between the ethylenic bond and the carboxyl group.

The other organic compounds which typically may be employed as a monomer in the copolymerized blends utilized in embodiment (b) of the invention or which may be polymerized and employed as a polymer in the blend of polymers utilized in embodiment (c) of the invention are organic compounds comprising 3 to about 20 carbon atoms and possessing a polymerizable ethylenically unsaturated hydrocarbon moiety in their molecular structure. A wide variety of such compounds including vinyl, vinylidene, and vinylene compounds are well known in the polymer art and may be readily employed in the present invention. A partial listing of suitable such ethylenically unsaturated organic monomers include vinylacetate, vinylpyrrolidone, styrene, acrylates and methacrylates including alkyl acrylates and alkyl methacrylates, such as methylmethacrylate, butylmethacrylate, and the like. Blends and copolymerized blends of such polymerizable monomers may also be used such as a terpolymer of vinylbutyral, vinylacetate, and vinylalcohol. Other particularly useful ethylenically unsaturated monomers capable of producing cross-linkable polymers include monomers containing active methylene groups. Such monomers containing cross-linkable active methylene groups are described in Smith, U.S. Pat. No. 3,459,790 issued Aug. 5, 1969.

The overcoat layer applied to form the element of this invention is useful with both inorganic photoconductors and organic photoconductors, but it is particularly advantageous with photoconductive layers comprised of an organic photoconductor in an electrically insulating polymeric organic film-forming binder. Electrophotographic elements including the novel overcoat layer described herein can be made up solely of the electrically conductive support, the photoconductive insulating layer and the overcoat layer, and may also include auxiliary layers between the support and the photoconductive layer, if desired. An interlayer may also be used between the photoconductive layer and the novel overcoat.

As used in the present specification, the term photoconductive layer or photoconductive insulating layer is defined to include a single layer containing a photoconductor and optionally various binder and/or sensitizing addenda or a multi-layer configuration containing 2 or more separate photoconductor-containing layers or 1 or more separate photoconductor-containing layers together with 1 or more separate layers containing sensitizing addenda for the photoconductor-containing layer.

The novel overcoated electrophotographic elements of the present invention can comprise any electrically conductive support suitable for use in electrophotography. For example, the support can be a sheet material having the appropriate conductivity, such as metal foil or conductive paper, on which the photoconductive insulating layer is coated. Alternatively, the support can be comprised of a polymeric film, such as a film of cellulose acetate, polyethylene, polypropylene, poly(ethylene terephthalate), and the like, covered with a conductive coating. Materials such as glass, wood, metal, fabric, paper, resin-coated paper, etc., can be utilized in place of the aforesaid polymeric film. A number of different compositions and techniques are known for forming the conductive coating on the support. For example, the conductive coating can be applied by evaporative deposition of a suitable metal, such as nickel, or by applying a solution of a conductive or semiconductive material, for example conductive carbon particles, and a resinous binder in a volatile solvent and evaporating the solvent to form the coating, or by vacuum deposition of the conductive or semi-conductive material. Metal-containing semi-conductor compounds, such as cuprous iodide or silver iodide, provide conductive coatings with particularly good characteristics. Conductive polymeric materials may also be used. Supports formed from conductive paper are also particularly useful with the elements described herein and represent a preferred embodiment of the invention.

Any of the insulating photoconductive layers utilized in electrophotography can be employed in the practice of this invention. Thus, for example, the photoconductors can be inorganic, organic, (including both polymeric and non-polymeric types), or organic-metallic compounds. Useful inorganic photoconductors include zinc oxide, zinc sulfide, titanium dioxide, cadmium sulfide, cadmium selenide, lead oxide, and the like. Useful organo-metallic photoconductors include derivatives of Group IIIa, IVa, and Va metals having at least one aminoaryl group attached to the metal atom. Among the various organic photoconductors which may be used the arylamines such as described in U.S. Pat. No. 3,240,597 issued Mar. 15, 1966, Klupfel et al U.S. Pat. No. 3,180,730 issued Apr. 27, 1965, and Brantly et al. U.S. Pat. No. 3,567,450 issued Mar. 2, 1971; polyarylalkanes described in Noe et al. U.S. Pat. No. 3,274,000 issued Sept. 20, 1966, Wilson U.S. Pat. No. 3,542,547 issued Nov. 24, 1970, and Seus et al U.S. Pat. No. 3,542,544 issued Nov. 24, 1970; as well as any of the photoconductors disclosed in Contois and Merrill Belgian Pat. No. 748,511, dated June 15, 1970, are especially preferred. A wide variety of polymeric resins are known for use as binders in the photoconductive layers employing organic photoconductors; examples of such binders including silicone resins, acrylic resins, polycarbonate resins, polyester resins, phenolic resins, and mixtures thereof. Similarly, polymeric photoconductors such as a poly(vinyl carbazole) and halogenated poly(vinyl carbazole) can also be used. As is well known in the art, various photosensitizing agents can also be incorporated in the photoconductive layer to effect a change in the sensitivity or speed of the system or a change in its spectral response characteristics. Examples of particularly effective photosensitizing agents include the pyrylium dyes, such as pyrylium and thiapyrylium dye salts described in U.S. Pat. No. 3,250,615 issued May 10, 1966 and U.S. Pat. No. 3,615,414 issued Oct. 26, 1971. Particularly useful organic photoconductive compositions useful in the invention are those including a co-crystalline complex of a poly(carbonate) resin and a pyrylium dye as described in U.S. Pat. No. 3,615,414 issued Oct. 26, 1971, and U.S. Pat. No. 3,679,407, issued July 25, 1972.

To promote the adhesion between contiguous layers of the electrophotographic element, it may be desirable to employ one or more subbing layers. For example, a subbing layer can be provided between the film support, such as a film of poly(ethylene terephthalate), and the conductive coating, such as a layer of evaporated nickel, or a subbing layer can be provided between the conductive coating and the photoconductive insulating layer. Particularly useful subbing layers are composed of interpolymers of vinylidene chloride, such as vinylidene chloride/acrylonitrile/acrylic acid terpolymers or vinylidene chloride/methyl acrylate/itaconic acid terpolymers.

In accordance with the present invention, the photoconductive insulating layer of an electrophotographic element is coated with a thin polymeric overcoat material comprising the above-described crosslinking agent and polymeric composition. As noted hereinabove, depending upon the particular embodiment of the present invention which is employed, the cross-linkable polymeric composition may have one of several different, but related compositions, namely composition (a), (b), or (c) as set forth hereinabove. In accordance with embodiment (a), the cross-linkable polymeric composition comprises a polymer of at least one $\alpha,\beta$-ethylenically unsaturated carboxylic acid or the partial alkyl ester thereof. Useful $\alpha,\beta$-ethylenically unsaturated carboxylic acids or their partial alkyl esters which may be used to prepare such a polymer are described hereinabove. In accordance with embodiment (a) of the invention, the polymer may be a homopolymer of a carboxylic acid or its partial alkyl ester; a copolymer of 2 or more $\alpha,\beta$-ethylenically unsaturated carboxylic acids; a copolymer of 1 or more $\alpha,\beta$-ethylenically unsaturated carboxylic acids with 1 or more partial alkyl esters of such acids; or a copolymer of 2 or more partial alkyl esters of $\alpha,\beta$-ethylenically unsaturated carboxylic acids. When a copolymer of 2 or more carboxylic acids or acid derivatives such as described above is utilized, the particular molar ratio of various monomeric components utilized to form the copolymer used is not critical. This, of course, should be readily apparent since, as noted above, one may use a homopolymer of a carboxylic acid as well as a copolymer of two or more carboxylic acids.

Concerning the overcoat composition denoted as embodiment (b) of the present invention hereinabove, it may be noted that the cross-linkable polymerized blend utilized in accordance with this embodiment of the invention should advantageously contain at least about 25 percent by weight of repeating units derived from an $\alpha,\beta$-ethylenically unsaturated carboxylic acid or its partial alkyl ester. Useful such acids and their partial alkyl esters are more fully described hereinabove. The other organic monomeric compounds which may be utilized in forming the copolymerized blend of embodiment (b) may be selected from a wide variety of organic compounds containing an ethylenically unsaturated moiety capable of copolymerizing with the aforementioned carboxylic acids or the partial alkyl ester thereof. Representative of such ethylenically unsaturated monomers are vinyl acetate, vinyl methyl ether, styrene and the like. These ethylenically unsaturated organic compounds are also described more fully hereinabove. Since the copolymerized blend of embodiment (b) is prepared using conventional copolymerizing techniques such as suspension polymerization, emulsion polymerization, and the like all of which are well-known and will be apparent to those skilled in the polymer art, extended discussion relating to the preparation of such copolymerized materials is deemed unnecessary. However, several representative polymerization procedures are set forth in the accompanying examples and may be referred to for more detailed information, if desired.

Concerning embodiment (c) of the present invention wherein a blend of a polymer of an $\alpha,\beta$-ethylenically unsaturated carboxylic acid and a polymer of at least one other ethylenically unsaturated organic compound is utilized, it may be observed that the proportions of the polymers utilized to form the polymer blends should be such that the polymer blend comprises at least about 25 percent by weight of a polymer of 1 or more $\alpha,\beta$-ethylenically unsaturated carboxylic acids or the partial alkyl esters thereof. Useful carboxylic acids and the partial alkyl esters thereof which may be utilized in this embodiment of the present invention are more specifically described hereinabove. Similarly, ethylenically unsaturated organic compounds which may be utilized to form the other polymers utilized in the polymer blend of embodiment (c) are also described more fully hereinabove. Advantageously, in accordance with embodiment (c) of the invention, it has been found that a polymer blend comprising a polymer of an $\alpha,\beta$-ethylenically unsaturated acid and a vinyl acetate polymer constitutes a particularly useful cross-linkable polymeric composition for use in the overcoat of the present invention.

As a partial listing of a few of the many suitable cross-linkable polymeric compositions which can be used in the overcoats of the electrophotographic elements of the present invention, the following are illustrative:

1. poly(acrylic acid)
2. poly(methacrylic acid)
3. poly(itaconic acid)
4. poly(styrene-co-maleic acid)
5. poly(vinylpyrrolidone-co-acrylic acid)
6. poly(styrene-co-methacrylic acid)
7. poly(methyl methacrylate-co-methacrylic acid)
8. poly(acetoacetoxyethyl methacrylate-co-vinyl acetate)
9. blend of poly(acrylic acid) and poly(vinyl acetate)
10. blend of poly(acrylic acid) and poly(vinyl butyral-co-vinyl acetate-co-vinyl alcohol)

In applying the photoconductive insulating layer to a support of an electrophotographic element according to the present invention or in applying the overcoat layer described herein on the photoconductive insulating layer, any of several different coating techniques can be employed. For example, spray coating, dip coating, swirl coating, extrusion hopper coating, air knife coating, and other well known coating procedures can be utilized. The polymers, copolymers, or polymer blends, used to form the overcoat layer, as hereinbefore described, are readily applied from liquid media as dispersions or solutions in solvent. Preferably, the overcoat is applied as a solution in solvent. The solvent chosen should be such that application of the overcoat layer will not harm the photoconductive layer, for example, the solvent used should not dissolve the hydrophobic resin used as the binder in the photoconductive layer. Of course, the solvent chosen must be capable of dissolving the cross-linking agent as well as the cross-linkable polymeric composition used in the overcoat layer. Examples of suitable solvents for forming the overcoat layer include organic solvents such as the lower alkanols, for example, methanol or ethanol, ketones, for example, acetone or methylethyl ketone, esters, for example, ethyl acetate or ethyl propionate, and aqueous-alkanol mixtures, such as water and one of the lower alkanols noted hereinabove. It is an important advantage of this invention that the cross-linkable polymeric composition used in the overcoat layer can be dissolved in readily available, low-cost solvents that will not adversely affect the underlying photoconductive layer.

Following application of the overcoat composition used in the present invention onto the surface of a photoconductive layer of an electrophotographic element, the composition is cured or set. Typically this is accomplished by heating the overcoat-liquid-containing dope which has been applied to the surface of the electrophotographic element. Generally, heating in air at a temperature above 50° C., preferably from about 65° C. to about 150° C., for a period of a few minutes to several hours is sufficient to dry and cure the overcoat, thereby resulting in the highly cross-linked overcoat of the present invention. Generally, heating at relatively high temperatures is avoided to assure that no deleterious effect is produced on the photoconductive layer. Thus, it will be apparent that the particular curing temperature selected will depend not only on the composition of the overcoat but also on the particular photoconductive layer being overcoated. When over-coating organic photoconductor-containing layers, it is desirable to use relatively low curing temperature, for example, temperatures in the range of about 50° C. to 150° C. to avoid damaging the organic photoconductive material. An overcoat containing a suitable cross-linkable polymeric composition and a melamine-formaldehyde resin of an imine-terminated cross-linking agent typically can be cured at a temperature within the range of 65° C to about 95° C. For this additional reason, the imine-terminated cross-linking agents and the melamine-formaldehyde resins described in greater detail hereinabove have been found particularly advantageous for use in the present invention.

The overcoat layers of this invention which may include a filler (e.g. clay, silica, titanium dioxide) preferably have a thickness in the range of from about 0.07 to about 10 microns when dry, and more particularly from about 0.1 to about 5 microns. Other layers making up the electrophotographic element can have thicknesses selected in accordance with conventional practice in the art of electrophotography.

The overcoat layers of the invention are preferably transparent or at least translucent to electromagnetic radiation of the type to which the underlying photoconductive composition is sensitive. Of course, if the conductive support on which the photoconductive composition is coated is transparent or translucent, the photoconductive composition may be exposed to electromagnetic radiation from the rear through the support. In such case the overcoat of the invention need not be transparent or translucent.

As is apparent, the overcoats used in the present invention are electrically insulating. Typically the overcoat used in the present invention has a specific resistivity on the order of at least about $10^{15}$ ohm-cm. as measured at 50 percent relative humidity. This is, however, an approximate resistivity figure and depending upon the particular electrographic process, overcoats having somewhat lower resistivities may also be useful.

The invention is further illustrated by the following examples of its practice. Certain of the examples, however, are presented for purposes of comparing the overcoated elements of the present invention to certain prior art overcoats. In the examples, the electrophotographic elements referred to are prepared by coating a conductive support with a suitable photoconductive composition. The conductive support comprises a poly(ethylene terephthalate) film base optionally bearing an adhesion layer on which is coated a layer of nickel, by vacuum evaporation, for example. Over the conducting nickle layer is coated a photoconductive layer comprising a triaryl methane photoconductor, a binder, and a cocrystalline complex of a resin and a thiapyrylium dye as is described in U.S. Pat. No. 3,615,414, noted earlier herein. Thereafter, the overcoat layer is applied as described in each of the examples which follow.

After the application of the overcoat layer, certain of the overcoated elements are further tested by subjecting them to various processing situations. In certain examples, electrographic processing including charging, exposure and development of an electrostatic charge pattern. This processing is accomplished by charging the overcoated electrophotographic element in the dark to approximately 600 volts (negative), exposing to an image with light from a 3000° K source, and developing the resultant electrostatic charge pattern in a magnetic brush development operation using a developer comprising finely-divided pigmented toner particles of a carbonate polymer having an inherent viscosity of about 0.15 and larger magnetic carrier particles. The carbonate polymeric toner particles are described in greater detail in U.S. Ser. No. 34,557 filed May 4, 1970, (French Pat. No. 2,090,986 issued Dec. 20, 1972), now U.S. Pat. No. 3,694,359 issued Sept. 26, 1972. Thereafter, the toner particles may be transferred to a paper receiver or fused to the photoconductive element by heating the element to approximately 130° C. for about 30 seconds. The elements are admirably suited for use in toner concentration monitoring system wherein the toner concentration is monitored by sampling the potential generated by a magnetic brush as it periodically contacts uncharged areas of the electrographic recording element as described, for example, in Trachtenberg and Morse U.S. Ser. No. 177,600 filed Sept. 3, 1971, (German Patent 7,232,112 issued Nov. 23, 1972), 3,719,165 issued Mar. 6, 1973.

In certain of the following examples the overcoated elements are subjected to a water drop test to measure the resistance of the overcoat to water and water spotting. This test is conducted as follows: A drop of distilled water is deposited on the surface of the overcoated electrophotographic element to be tested. The water droplet is allowed to remain on the surface approximately 1 hour. Any remaining water is then blotted off the overcoated element. The over-coated electrophotographic element is then visually examined to discover whether the water droplets have produced any deleterious effect on the overcoated element. Overcoated elements which exhibit poor performance in this water spot test may be easily distinguished from overcoated elements exhibiting good or satisfactory performance in the water spot test. That is, overcoated elements incapable of passing the water drop test exhibit a hazy, often crystallized appearance in the area of the overcoat surface contacted by the water droplets. This is due to the interaction of the water droplet with the overcoats such as by penetration of the water droplet into the overcoat or by possible leaching of materials contained in the overcoat composition. On the other hand, overcoated elements exhibiting good performance when subjected to the water drop test show no sign of water hazing or spotting in those areas of the overcoated elements which are contacted by the water droplet. Formation of a water spot on overcoated element is highly undesirable because it is indicative of the instability of the overcoated element under conditions of moderate or relatively high humidity. Under such conditions an unstable overcoated photoconductive element exhibits lateral conductivity. Thus, any applied charge image tends to spread out with the result that the final developed image becomes diffuse and unsharp.

The following examples are included for a further understanding of the invention.

Examples A, B, and C set forth hereinafter describe typical polymerization procedures for producing the cross-linkable polymer and copolymer compositions used in the overcoated elements of the present invention. However, it will be appreciated that these examples are presented merely for purposes of illustration as the cross-linkable polymer and copolymer compositions used in the present invention are generally known in the polymer art as well as processes for making these cross-linkable polymer and copolymer compositions.

EXAMPLE A

Poly(styrene-co-maleic acid)

Equimolar amounts of styrene and maleic anhydride are heated in benzene as solvent with 1% benzoyl peroxide to 80° C. at which temperature precipitation polymerization begins. External cooling is needed to control the reaction. The precipitate is collected and dissolved in acetone to which has been added 50% in excess of the amount of the water necessary to hydrolyze the anhydride. This solution is refluxed overnight then poured into water to precipitate a product of poly(styrene-co-maleic acid).

EXAMPLE B

Poly(vinylpyrrolidone-co-acrylic acid)

Equal amounts of vinylpyrrolidone and acrylic acid are copolymerized at 60° C in tetrahydrofuran as solvent with azobisisobutyronitrate as initiator. The poly(-vinylpyrrolidone-co-acrylic acid) product precipitates as it is polymerized.

EXAMPLE C

Poly(acetoacetoxyethyl methacrylate-co-vinyl acetate).

Acetoacetoxyethyl methacrylate and vinyl acetate monomers are copolymerized in methanol at 60° C. with azobisisobutyronitrate as initiator.

EXAMPLE 1

In this example a series of different overcoat compositions are prepared and coated on substantially identical electrophotographic elements as described above. This example illustrates the improved resistance to humidity (i.e. the humidity independence) of the overcoated elements of the present invention in comparison to electrographic elements having overcoats containing smaller amounts of cross-linking agent but otherwise having an identical polymeric compositions. In this example a series of overcoat compositions are subjected to the above-described water spot test. As indicated hereinafter in Tables I-V the overcoat compositions of the present invention containing 10% or more of cross-linking agent exhibit satisfactory or good resistance to water spotting whereas overcoat compositions comprising less than 10% of the cross-linking agents exhibit poor resistance to water spotting. In each of Tables I–V a series of different overcoat compositions are prepared. The composition of the overcoat varies as indicated in Tables I–V that is, the amount of cross-linkable polymer is steadily decreased while the amount of cross-linking agent in the overcoat composition is steadily increased. In each case the overcoat composition is overcoated onto the electrophotographic element described hereinabove from an alcoholic solution. The overcoat composition is then dried and heated adequately to promote crosslinking and to cure and set the overcoat. Typically, heating for a period of about 3 to about 5 minutes at about 120° C. is adequate. In Table I–III the cross-linking agent utilized is a melamine-formaldehyde resin purchased from the American Cyanamide Co. under the tradename of Cymol 300. In Table IV the cross-linking agent in an imine-terminated prepolymer purchased from Interchemical Co. under the tradename of ITP-63 and in Table V the cross-linking agent is a urea-formaldehyde resin sold under the tradename Uformite F-240. The cross-linkable polymer composition used in Table I is a homopolymer of poly(acrylic acid). The cross-linkable polymer composition utilized in Table II is a blend of a homopolymer of poly(acrylic acid) and a homopolymer of poly(vinylacetate). The cross-linkable polymer composition used in Table III also contains a homopolymer of poly(acrylic acid) and a homopolymer of poly(vinylacetate). The cross-linkable polymer composition in Tables IV and V is composed of a homopolymer of poly(acrylic acid).

As indicated from the results set forth in Tables I–V overcoat compositions substantially similar to those of the present invention except containing relatively smaller amounts of cross-linking agent exhibit poror resistance to water spotting. These overcoates when utilized under moderate or relatively high humidity conditions in an office-copy device exhibit lateral conductivity and thus produce image-spreading, i.e. fuzzy, diffuse and unsharp images are obtained on the copies produced by such an overcoated electrophotographic element. (It should be observed that this Example is concerned with the humidity dependence of various overcoat compositions. As noted hereinbefore, other properties of an overcoat composition for a photoconductive element must also be considered, for example, hardness, electrical and sensitometric properties, etc. Accordingly, Tables I and IV are useful primarily as a means of illustrating that certain overcoat compositions are generally unsuitable (due to humidity dependence) as overcoat compositions for a photoconductive element to be sure in a conventional office copying machine.)

TABLE I

| No. | PAA* Parts By Weight | Cymel 300 Parts By Weight | Water Spot Test |
|---|---|---|---|
| 0 | 100 | 0 | Poor |
| 1 | 95 | 5 | Poor |
| 2 | 90 | 10 | Poor |
| 3 | 80 | 20 | Satisfactory |
| 4 | 60 | 40 | Satisfactory |
| 5 | 40 | 60 | Satisfactory |
| 6 | 20 | 80 | Satisfactory |
| 7 | 10 | 90 | Good |
| 8 | 5 | 95 | Good |

*PAA is poly(acrylic acid)

TABLE II

| No. | PAA* Parts By Weight | AYAT** Parts By Weight | Cymel 300 Parts By Weight | Water Spot Test |
|---|---|---|---|---|
| 0 | 97.50 | 2.50 | 0.0 | Poor |
| 1 | 92.60 | 2.50 | 4.90 | Poor |
| 2 | 87.75 | 2.50 | 9.75 | Poor |
| 3 | 78.00 | 2.50 | 19.50 | Satisfactory |
| 4 | 58.50 | 2.50 | 39.00 | Satisfactory |
| 5 | 39.00 | 2.50 | 58.50 | Satisfactory |
| 6 | 19.50 | 2.50 | 78.00 | Good |
| 7 | 9.75 | 2.50 | 87.75 | Good |
| 8 | 4.90 | 2.50 | 92.60 | Good |

*PAA is poly(acrylic acid)
**AYAT is poly(vinyl acetate)

TABLE III

| No. | PAA* Parts By Weight | AYAT** Parts By Weight | Cymel 300 Parts By Weight | Water Spot Test |
|---|---|---|---|---|
| 0 | 90.0 | 10.0 | 0.0 | Poor |
| 1 | 85.5 | 10.0 | 4.5 | Poor |
| 2 | 81.0 | 10.0 | 9.0 | Poor |
| 3 | 72.0 | 10.0 | 18.0 | Satisfactory |
| 4 | 54.0 | 10.0 | 36.0 | Satisfactory |
| 5 | 36.0 | 10.0 | 54.0 | Satisfactory |
| 6 | 18.0 | 10.0 | 72.0 | Satisfactory |
| 7 | 9.0 | 10.0 | 81.0 | Good |
| 8 | 4.5 | 10.0 | 85.5 | Good |

*PAA is poly(acrylic acid)
**AYAT is poly(vinyl acetate)

TABLE IV

| No. | PAA* Parts By Weight | ITP-63 Parts By Weight | Water Spot Test |
|---|---|---|---|
| 1 | 100 | 0 | Poor |
| 2 | 95 | 5 | Poor |
| 3 | 90 | 10 | Good |
| 4 | 80 | 20 | Good |
| 5 | 60 | 40 | Good |
| 6 | 40 | 60 | Good |
| 7 | 20 | 80 | Good |
| 8 | 10 | 90 | Good |

*PAA is poly(acrylic acid)

TABLE V

| No. | PAA* Parts By Weight | Uformite F-240 Parts By Weight | Water Spot Test |
|---|---|---|---|
| 1 | 100 | 0 | Poor |
| 2 | 60 | 40 | Good |
| 3 | 50 | 50 | Good |

*PAA is poly(acrylic acid)

EXAMPLE 2

An electrophotographic element of the type described hereinabove is overcoated with a polymeric material containing 50% by weight of poly(acrylic acid) and 50% by weight of a trifunctional iminie-terminated pre-polymer cross-linking agent. This polymeric material is dissolved in methanol to form a polymer solution containing 3% solids and coated onto the electrophotographic element to obtain an overcoat having a thickness when dry of approximately 0.5 micron. The overcoat is cured at a temperature of between 65° C.–95° C. Adhesion of this overcoat layer to the electrophotographic element is quite good. In comparison, a similar control element is overcoated from a methanol solution containing poly(acrylic acid) only. The control poly(acrylic acid) overcoat exhibits very poor adhesion to the element and poor resistance water spotting.

The highly cross-linked polymer overcoat of the present invention is found to contain little or no microdeposits and exhibits little or no scumming when subjected to electrographic magnetic-brush development processing. The highly cross-linked overcoat exhibits little detectable abrasion and little wear when subjected to 5000 imaging cycles in a magnetic brush developing process.

EXAMPLE 3

Three overcoated elements of the type described in Example 1 are made with overcoat dry thicknesses of 1μ, 2μ, and 3μ. Results of tests run on these samples duplicated those described in Example 2.

EXAMPLE 4

Three thousand superimposed images are made on a photoconductor element of the type described in Example 5, one-half of which was overcoated with the 1μ thick cross-linked polymer of Example 2, and the other half left without an overcoat. Cleaning is significantly better on the overcoated side; no (residual) image is left on the overcoated side of the film after cleaning whereas there is a clear, frosted image on the unovercoated side.

EXAMPLE 5

The electrophotographic element described in Example 2 was overcoated with a mixture of 10% by weight of a diglycidyl ether cross-linking agent sold under the tradename Araldite RD-2 by Ciba Products Co. and 90% by weight of the poly(styrene-comaleic acid) polymer described in Example 1. The coating is applied from a 3% methanol solution to a dry thickness of about 1μ. The coated material is then cured at 120° C. for 10–12 minutes. Abrasion and water resistance of this layer are good.

EXAMPLE 6

The electrophotographic element described in Example 2 is overcoated with a mixture of 20 weight percent ITP-63 and 80 weight percent poly(styrene-co-maleic acid) prepared as described in Example 1. The coating is applied from a 3% methanol solution to a dry thickness of about 1'. Excellent wear, water resistance, and sensitometry are evident. Adhesion is good. No microdeposit or scum are evident. The curing temperature is 65° C.–95° C.

EXAMPLE 7

The electrophotographic element described in Example 2 is overcoated with a mixture of 10 weight percent ITP-63 and 90 weight percent poly(vinylpyrrolidone-co-acrylic acid) prepared as described in Example B. The coating is applied from a 3% methanol solution to a dry thickness of about 1μ. Excellent wear characteristics, sensitometry, and adhesion are evident. Water resistance is fair. The curing temperature is 65° C.–95° C.

EXAMPLE 8

The electrophotographic element described in Example 2 is overcoated with a mixture of 50% ITP-63 and 50% poly(methacrylic acid) by weight, to a dry thickness of 1μ from a 3% methanol solution. Excellent wear characteristics and water resistance are obtained. Very little microdeposit accumulation is noted.

EXAMPLE 9

The electrophotographic element described in Example 2 is overcoated with a mixture of 70% poly(styrene-co-methacrylic acid) and 30% ITP-63 by weight, to a dry thickness of 1μ from a 3% methanol solution. The cross-linkable polymer is prepared from a copolymerized blend of about 55% by weight styrene and 45% by weight methacrylic acid. Wear characteristics, sensitometry, and water resistance are good. Adhesion is good and little microdeposit accumulation is noted.

EXAMPLE 10

The electrophotographic element described in Example 2 is overcoated with a mixture of 70% poly(styrene-co-acrylic acid) and 30% ITP-63 by weight, to a dry thickness of 1μ from a 3% methanol solution. The cross-linkable polymer is prepared from a copolymerized blend of about 60% by weight styrene and 40% by weight acrylic acid. Results duplicate those of Example 5

EXAMPLE 11

The electrophotographic element described in Example 2 is overcoated with a mixture of 90% poly(methylmethacrylate-co-acrylic acid) and 10% ITP-63 by weight, to a dry thickness of 1μ from a 3% methanol solution. Wear characteristics, water resistance and sensitometry are excellent. Little microdeposit accumulation is noted.

EXAMPLE 12

The electrophotographic element described in Example 2 is overcoated with a mixture of 80% poly(methyl methacrylate-co-methacrylic acid) and 20% ITP-63 by weight, to a dry thickness of 1μ from a 3% methanol solution. The cross-linkable polymer is prepared from a copolymerized blend of about 68 percent ot 76 weight percent methyl methacrylate and from about 32 to 24 weight percent methacrylic acid. Wear characteristics are very good; no visible microdeposit accumulation is noted when subjected to the above-described electrographic processing including charging, exposure, and development.

EXAMPLE 13

The electrophotographic element described in Example 2 is overcoated with a mixture of 90% poly(butymethacrylate-co-methacrylic acid) and 10% ITP-63 by weight, to a dry thickness of 1μ from a 3% methanol solution. The cross-linkable polymer is prepared from a copolymerized blend of about 62% by weight butylmethacrylate and 38% by weight methacrylic acid. Wear characteristics and sensitometry are very good; a small amount of microdeposit accumulation is noted, but water resistance is excellent when subjected to the above-described electrographic processing including charging, exposure, and development.

EXAMPLE 14

The electrophotographic element described in Example 2 is overcoated with a mixture of 50% poly(styrene-co-itaconic acid) and 50% ITP-63 by weight, to a dry thickness of 1μ from a 3% methanol solution. The cross-linkable polymer is prepared from a copolymerized blend of about 56% by weight styrene and 43% by weight itaconic acid. Wear characteristics, sensitometry and water resistance are outstanding; adhesion is good and no visible microdeposit accumulation is noted when subjected to the above described electrographic processing including charging, exposure and development.

The invention has been described in detail with particular reference to preferred embodiments thereof, but, it will be understood that variations and modifications can be effected within the spirit and scope of the invention.

We claim:

1. In an electrophotographic element comprising an electrically conductive support having thereon a photoconductive insulating composition and an electrically insulating overcoat layer for said photoconductive composition, the improvement wherein said overcoat layer comprises a hydrophobic, cured, highly cross-linked polymeric material formed in situ by cross-linking a composition consisting essentially of a cross-linking polymeric composition and at least 20 percent by weight of an organic cross-linking agent therefor, said highly cross-linked polymeric material being the reaction product of said cross-linking agent and said cross-linkable polymeric composition, said polymeric composition comprising a member selected from the group consisting of:

a. a polymer of at least one $\alpha,\beta$-ethylenically unsaturated carboxylic acid or the alkyl half ester thereof, b. a copolymerized blend comprising at least 25% by weight of a $\alpha,\beta$-ethylenically unsaturated carboxylic acid or the alkyl half ester thereof and at least one other organic compound comprising 3 to about 20 carbon atoms and a polymerizable ethylenically unsaturated hydrocarbon moiety, and c. a blend comprising at least 25 percent by weight of a polymer of at least one $\alpha,\beta$-ethylenically unsaturated carboxylic acid or the alkyl half ester thereof and a polymer of at least one other organic compound comprising 3 to about 20 carbon atoms and a polymerizable ethylenically unsaturated hydrocarbon moiety.

2. The invention as defined in claim 1 wherein said cross-linking agent is a member selected from the group consisting of diepoxy reactive modifiers, aminoplast resins, phenol resins, dialdehydes, formaldehyde, bis(vinyl-sulfonyl) compounds, and imine-terminated cross-linking agents.

3. The invention as defined in claim 1 wherein said cross-linking agent consists essentially of an imine-terminated cross-linking agent or a melamine-formaldehyde resin.

4. An electrophotographic element comprising an electrically conductive support, an organic photoconductive insulating composition on one side of said support, and an electrically insulating overcoat layer for said photoconductive composition, said overcoat layer comprising a hydrophobic, cured, highly cross-linked polymeric material formed in situ by cross-linking a composition consisting essentially of a cross-linkable polymeric composition and at least 20% by weight of an organic cross-linking agent therefor, said highly cross-linked polymeric material being the reaction product of said cross-linking agent and said cross-linkable polymeric composition, said polymeric composition comprising a member selected from the group consisting of:

a. a polymer of at least one $\alpha,\beta$-ethylenically unsaturated carboxylic acid comprising 3 to about 20 carbon atoms, b. a copolymerized blend comprising at least 25% by weight of an $\alpha,\beta$-ethylenically unsaturated carboxylic acid comprising 3 to about 20 carbon atoms and at least one other organic compound comprising 3 to about 20 carbon atoms and a polymerizable ethylenically unsaturated hydrocarbon moiety, and c. a blend comprising at least 25% by weight of a polymer of at least on $\alpha,\beta$-ethylenically unsaturated carboxylic acid comprising 3 to about 20 carbon atoms and a polymer of at least one other organic compound comprising 3 to about 20 carbon atoms and a polymerizable ethylenically unsaturated hydrocarbon moiety.

5. The invention as defined in claim 4 wherein said cross-linking agent is selected from the group consisting of diepoxy reactive modifiers, aminoplast resins, phenol resins, dialdehydes, formaldehyde, bis(vinyl-sulfonyl) compounds, and imine-terminated cross-linking agents.

6. The invention as defined in claim 4 wherein the $\alpha,\beta$-ethylenically unsaturated carboxylic acid contained in said composition comprises from 3 to about 8 carbon atoms.

7. The invention as defined in claim 4 wherein said cross-linkable polymeric composition is selected from the group consisting of poly(acrylic acid), poly(methacrylic acid), poly(itaconic acid), poly(styrene-co-maleic acid), poly(vinyl-pyrrolidone-co-acrylic acid), poly(styrene-co- methacrylic acid) poly(methyl methacrylate-co-methacrylic acid), poly(acetoacetoxyethyl methacrylate-co-vinyl acetate), blend of poly(acrylic acid) and poly(vinyl acetate), and blend of poly(acrylic acid) and poly(vinyl butyral-co-vinyl acetate-co-vinyl alcohol).

8. The invention as defined in claim 4 wherein said cross-linking agent is an imine-terminated cross-linking agent.

9. An electrophotographic element comprising an electrically conductive support, an organic photoconductive insulating composition on one side of said support, and an electrically insulating overcoat layer for said photoconductive composition, said overcoat layer comprising a hydrophobic, cured, highly cross-linked polymeric material formed in situ by cross-linking a composition consisting essentially of poly(acrylic acid) and at least 20% by weight of a trifunctional imine terminated cross-linking agent having a molecular weight within the range of from about 1000 to about 10,000 and an imine content within the range of from about 0.3 to about 0.8 milliequivalents of imine per gram of said agent, said highly cross-linked polymeric material being the reaction product of said agent and said poly(acrylic acid).

10. An electrophotographic element comprising an electrically conductive support, an organic photoconductive insulating composition on one side of said support, and an electrically insulating overcoat layer on said photoconductive composition, said overcoat layer comprising a hydrophobic, cured, highly cross-linked polymeric material formed in situ by cross-linking a composition consisting essentially of a cross-linkable polymeric composition and at least 20% by weight of an imine-terminated, cross-linking agent, said polymeric composition comprising a blend of a poly(vinylacetate) polymer and at least 25% by weight of poly(acrylic acid), said highly cross-linked polymeric material being the reaction product of said cross-linking agent and said polymeric composition.

11. An electrophotographic element comprising an electrically conducting support, a photoconductive insulating composition comprising a resinous binder, an organic photoconductor and a co-crystalline complex of a polycarbonate resin and a thiapyrylium dye, and an electrically insulating overcoat layer for said photoconductive composition, said overcoat layer comprising a hydrophobic, cured, highly cross-linked polymeric material formed in situ by cross-linking a composition consisting essentially of a cross-linkable polymeric composition and at least 20% by weight of a cross-linking agent therefor, said polymeric composition comprising a member selected from the group consisting of:

a. a polymer of at least one $\alpha,\beta$-ethylenically unsaturated carboxylic acid comprising 3 to about 20 carbon atoms, b. a copolymerized blend comprising at least 25% by weight of an $\alpha,\beta$-ethylenically unsaturated carboxylic acid comprising 3 to about 20 carbon atoms and at least one other organic compound comprising 3 to about 20 carbon atoms and a polymeriazble ethylenically unsaturated hydrocarbon moiety, and c. a blend comprising at least 25% by weight of a polymer of at least one $\alpha,\beta$-ethylenically unsatucarboxylic acid comprising 3 to about 20 carbon atoms and a polymer of at least one other organic compound comprising 3 to about 20 carbon atoms and a polymerizable ethylenically unsaturated hydrocarbon moiety:

said cross-linking agent consisting essentially of an imine-terminated cross-linking agent, a melamine-formaldehyde resin cross-linking agent or a urea-formaldehyde resin cross-linking agent, said highly cross-linked polymeric material being the reaction product of said cross-linking agent and said cross-linkable polymeric composition.

* * * * *